US010923796B2

(12) United States Patent
Oestberg et al.

(10) Patent No.: US 10,923,796 B2
(45) Date of Patent: Feb. 16, 2021

(54) ADAPTABLE LOCKING MECHANISM FOR COST-EFFECTIVE SERIES PRODUCTION

(71) Applicant: SAAB AB, Linkoeping (SE)

(72) Inventors: Johan Oestberg, Goeteborg (SE); Omar Isaksson, Goeteborg (SE)

(73) Assignee: SAAB AB, Linkoeping (SE)

( * ) Notice: Subject to any disclaimer, the term of this patent is extended or adjusted under 35 U.S.C. 154(b) by 0 days.

(21) Appl. No.: 16/652,918

(22) PCT Filed: Oct. 4, 2017

(86) PCT No.: PCT/SE2017/050969
§ 371 (c)(1),
(2) Date: Apr. 1, 2020

(87) PCT Pub. No.: WO2019/070172
PCT Pub. Date: Apr. 11, 2019

(65) Prior Publication Data

US 2020/0321683 A1 Oct. 8, 2020

(51) Int. Cl.
*H01Q 1/08* (2006.01)
*H01Q 1/12* (2006.01)
(Continued)

(52) U.S. Cl.
CPC ..... *H01Q 1/18* (2013.01); *H01Q 1/08* (2013.01); *H01Q 1/1235* (2013.01); *H01Q 1/27* (2013.01); *H01Q 3/02* (2013.01)

(58) Field of Classification Search
CPC ..... F41A 23/02; F41A 23/34; F41A 23/36; F41A 23/52; H01Q 1/08; H01Q 1/12;
(Continued)

(56) References Cited

U.S. PATENT DOCUMENTS 3,968,496 A * 7/1976 Brunvoll ..... H01Q 1/18 343/765
4,209,789 A * 6/1980 Snedkerud ..... H01Q 1/34 343/765
(Continued)

FOREIGN PATENT DOCUMENTS

DE 2037311 A1 2/1972
FR 2524589 A1 10/1983
(Continued)

OTHER PUBLICATIONS

International Searching Authority, International Search Report and Written Opinion for Application No. PCT/SE2017/050969, dated Jun. 11, 2018, 14 pages, The Swedish Patent and Registration Office, Sweden.
(Continued)

*Primary Examiner* — Tho G Phan
(74) *Attorney, Agent, or Firm* — Alston & Bird LLP

(57) ABSTRACT

The present invention regards a platform and elevation support arrangement (1) and a method for manufacture thereof. An elevation support (3) is to be hingedly mounted to a platform (5) around a first axis (X1) extending along a first direction (B1) via a hinge member (7) arranged between the platform (5) and the elevation support (3); and wherein the elevation support (3) is configured to be locked to the platform (5) in a fixed position by means of an adjustable locking mechanism (9), comprising a first and a second opening (11', 11") arranged at a first distance (D1) from each other and comprising a first and second sliding shaft element (13', 13") arranged at a second distance (D2) from each other each configured to slide along a second direction (B2) perpendicular to the first axis (X1). The method comprises the steps of providing the platform (5), the elevation support (3) and the adjustable locking mechanism (9); mounting the elevation support (3) to the platform (5);
(Continued)

adjusting the adjustable locking mechanism (9) so that the first distance (D1) corresponds with the second distance (D2); and locking the adjustable locking mechanism (9) by sliding the first shaft element (13') into the first opening (11') and by sliding the second shaft element (13") into the second opening (11").

7 Claims, 4 Drawing Sheets

(51) Int. Cl.
*H01Q 1/18* (2006.01)
*H01Q 1/27* (2006.01)
*H01Q 3/02* (2006.01)

(58) Field of Classification Search
CPC ..... H01Q 1/1235; H01Q 1/18; H01Q 1/27; H01Q 3/02
See application file for complete search history.

(56) References Cited

U.S. PATENT DOCUMENTS 4,404,565 A * 9/1983 Gurney ..... H01Q 15/16 343/881
4,696,196 A * 9/1987 Vucevic ..... H01Q 1/18 74/5.22
4,786,912 A * 11/1988 Brown ..... H01Q 1/18 343/757
4,920,350 A * 4/1990 McGuire ..... H01Q 1/18 343/709
5,554,998 A * 9/1996 Sherwood ..... H01Q 1/08 343/763
6,977,618 B1 12/2005 Hanewinkel, III et al.
10,283,837 B2 * 5/2019 Larson ..... F16F 15/00
2002/0140620 A1 * 10/2002 Yamauchi ..... H01Q 3/02 343/882
2010/0253586 A1 10/2010 Tippit et al.

FOREIGN PATENT DOCUMENTS

GB 478369 A 1/1938
GB 1086213 A 10/1967
WO WO 2006/0031708 A2 3/2006

OTHER PUBLICATIONS

International Preliminary Examining Authority, International Preliminary Report on Patentability for Application No. PCT/SE2017/050969, dated Jan. 28, 2020, 26 pages, The Swedish Patent and Registration Office, Sweden.

* cited by examiner

ADAPTABLE LOCKING MECHANISM FOR COST-EFFECTIVE SERIES PRODUCTION

CROSS REFERENCE TO RELATED APPLICATIONS

This application is a National Stage Application, filed under 35 U.S.C. § 371, of International Application No. PCT/SE2017/050969, filed Oct. 4, 2017; the contents of which as are hereby incorporated by reference in their entirety.

BACKGROUND

Related Field

The present invention relates to a method for manufacture of a platform and elevation support arrangement, wherein an elevation support is to be pivoted arranged to a platform. The present invention also relates to the platform and elevation support arrangement per se.

The present invention primary concern the industry, which manufactures mobile platforms equipped with raising arrangements for raising and lowering antennas and/or radars from platforms, such as vehicles, but is not limited to these.

The elevation support may be used in the military sector as well as the civil sector, especially for applications like radio relay systems or telecommunication and radar systems. Hydraulic and/or pneumatic actuators may be used for raising the elevation support from the platform.

The elevation support, e.g. supporting a Medium/Long-Range Surveillance Radar, may be pivotally hinged to a platform of a vehicle.

The platform and elevation support arrangement can be a part of a radar system providing continuously air surveillance/air defence/artillery naval multifunctional awareness.

It is important that the hinge member and locking mechanism for locking the elevation support to the platform exhibit high tolerance fit since the platform and elevation support arrangement is exposed for high forces and vibrations during transport of the elevation support in a lowered and locked state to the platform.

The current manufacture of a platform and elevation support arrangement is time-consuming and involves high production costs. The manufacture of the platform and elevation support arrangement requires proper machining of the first and a second opening of the elevation support as the first distance measure must correspond with the second distance measure.

Description of Related Art

One way to shortening the production time is to make the diameter of the respective first and second opening of the elevation support larger than the diameter of the respective first and second sliding shaft element. In such way is achieved a clearance fit or gap between the opening and the sliding element. The respective measure of the first and second distance is thereby not crucial and workshop personnel can easy mount the elevation support to the platform. The clearance gained by the clearance fit can thus be used as an additional tolerance for the first and second distance tolerance.

However, by such loose fit and clearance gap between the elevation support and the platform within the locking mechanism will cause that the respective sliding shaft will rattle about in the respective opening causing vibration, shaft wear, bearing wear and noise, etc. of the elevation support.

BRIEF SUMMARY

There is an object to reach a cost-effective manufacture of a platform and elevation support arrangement.

There is also an object to provide a platform and elevation support arrangement that comprises a compact and adjustable locking mechanism.

There is also an object to promote the method for manufacture of a platform and elevation support arrangement and rendering more effective mounting of an individual elevation support to an individual platform in a workshop.

A yet further object is to provide a method for manufacture of a platform and elevation support arrangement, which method provides a platform and elevation support arrangement that can be transported without generating any vibrations, wear and noise.

This or at least one of said objects has been achieved by a method for manufacture of a platform and elevation support arrangement; wherein an elevation support is to be hingedly mounted to a platform around a first axis extending along a first direction via a hinge member arranged between the platform and the elevation support; and wherein the elevation support is configured to be locked to the platform in a fixed position by means of an adjustable locking mechanism, comprising a first and a second opening arranged at a first distance from each other and comprising a first and second sliding shaft element arranged at a second distance from each other each configured to slide along a second direction perpendicular to the first axis. The method comprises the steps of providing the platform, the elevation support and the adjustable locking mechanism; mounting the elevation support to the platform; adjusting the adjustable locking mechanism so that the first distance corresponds with the second distance; and locking the adjustable locking mechanism by sliding the first shaft element into the first opening and by sliding the second shaft element into the second opening.

In such way the manufacture is made cost-effective. Time consuming production of the first and second opening for achieving their correct center-to-center measurement (corresponding with the center-to-center measurement between the first and second sliding shaft element) is not any longer critical.

The adjustable locking mechanism may provide that the opening will be moved in a third direction (straight and/or curved) in an imaginary plane being parallel with the first axis.

The first distance may extend along a direction parallel with the first axis.

The second distance may extend along a direction parallel with the first axis.

The step of adjusting the adjustable locking mechanism may comprise moving the at least first opening in a third direction in an imaginary plane being parallel with the first axis.

The step of adjusting the adjustable locking mechanism may comprise moving the at least first opening in a third direction parallel or essentially parallel with the first direction.

The step of adjusting the adjustable locking mechanism may comprise moving at least the first opening and/or at least the first sliding shaft element in a third direction parallel or essentially parallel with the first direction.

The moving of the first opening may be performed by rotating a first eccentric housing comprising said first opening around a first eccentric housing axis extending perpendicular to the first axis.

In such way is achieved a simple way to adapt the center-to-center measurement between the first and second opening to correspond with the center-to-center measurement between the first and second sliding shaft element.

Said moving of the first opening and/or the first sliding shaft element may be performed by rotating a first eccentric housing comprising said first opening and/or the first sliding shaft element around an eccentric housing axis extending perpendicular to the first axis.

In such way is achieved that a tight fit between the first sliding shaft element and the first opening in the locked position for not providing disadvantageous force transmission from the elevation support to the platform during transport of the platform and elevation support arrangement.

The step of locking the locking mechanism in a fixed position may comprise the step of securing a fixing device to the locking mechanism.

The first opening may be configured to be eccentrically rotatable around a first central axis of the first eccentric housing for adapting the first distance to the same measure as that of the second distance.

The first central axis may extend in a direction corresponding with the second direction.

The second opening may be eccentrically rotatable around a second central axis of a second eccentric housing for adapting the first distance to the same measure as that of the second distance.

The second central axis may extend in a direction corresponding with the second direction.

An elevation support may be hingedly mounted to a platform around a first axis extending along a first direction via a hinge member arranged between the platform and the elevation support; and wherein the elevation support is configured to be locked to the platform in a fixed position by means of a locking mechanism, comprising a first and a second opening arranged at a first distance from each other and comprising a first and second sliding shaft element arranged at a second distance from each other and each is configured to slide along a second direction. The locking mechanism may comprise an adjusting device configured to move at least the first opening and/or at least the first sliding shaft element so that the first distance corresponds with the second distance; and a first drive member configured to slide the first shaft element into the first opening and a second drive member configured to slide the second shaft element into the second opening.

The first opening may exhibit a first central opening axis extending in the second direction when the elevation support is locked to the platform in said fixed position.

The second opening may exhibit a second central opening axis extending in the second direction when the elevation support is locked to the platform in said fixed position.

The fit may be a light interference fit.

The adjusting device may be configured to move the first opening in a third direction parallel or essentially parallel with the first direction enabling that the first distance corresponds with the second distance.

The adjusting device may be configured to move the first sliding shaft element in a third direction parallel or essentially parallel with the first direction.

The first opening may be cylindrical and may define a first opening central axis extending through the first opening, the first opening is housed in a first eccentric housing defining a first housing central axis, wherein the first opening is eccentrically arranged in the first eccentric housing.

The first opening central axis may be eccentrically arranged relatively the first housing central axis.

The first eccentric housing may be rotatable arranged in the elevation support and the first sliding shaft element is arranged in the platform.

A second eccentric housing may be rotatable arranged in the elevation support and the second sliding shaft element is arranged in the platform.

The first eccentric housing may be rotatable arranged in a first bracket of the elevation support and the second opening is arranged in a second bracket of the elevation support.

The first eccentric housing may be rotatable arranged in the elevation support by being arranged in a bearing member facing the elevation support.

The bearing member may be a slide bearing, a roller bearing, ball bearing or other.

The elevation support may carry a radar antenna unit.

The locking the locking mechanism may be configured to be secured in a fixed position relative the elevation support by means of a fixing device.

BRIEF DESCRIPTION OF THE FIGURES

The present invention will now be described by way of examples with references to the accompanying schematic drawings, of which.

DETAILED DESCRIPTION OF VARIOUS EMBODIMENTS

Hereinafter, embodiments of the present invention will be described with reference to the accompanying drawings, wherein for the sake of clarity and understanding of the invention some details of no importance may be deleted from the drawings.

Figure 1A:
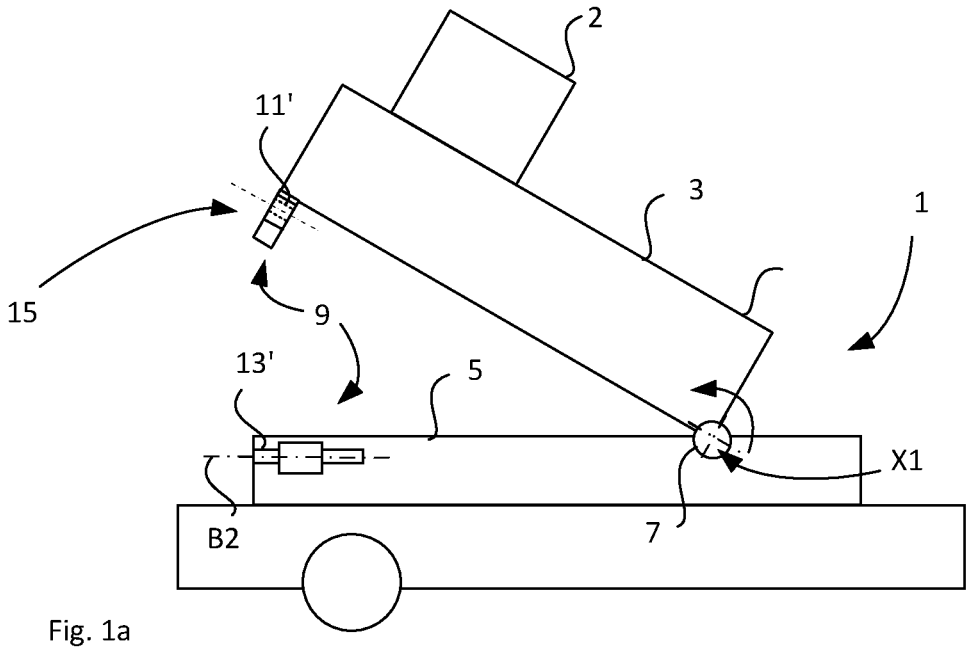
FIG. 1*a* illustrates a platform and elevation support arrangement according to a first example carrying a radar antenna unit in raised position.

FIG. 1*a* illustrates a platform and elevation support arrangement 1 according to a first example carrying a radar antenna unit 2 in raised (elevated) position. An elevation support 3 is hingedly mounted to a platform 5 around a first axis X1 extending along a first direction via a hinge member 7 arranged between the platform 5 and the elevation support 3.

Figure 3:
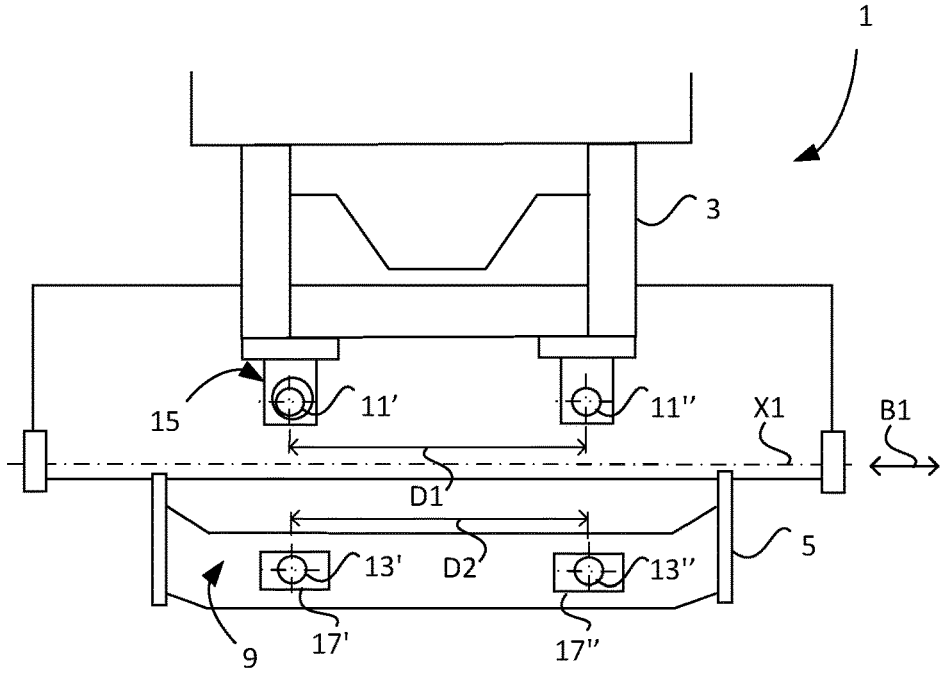
FIG. 3 illustrates a platform and elevation support arrangement according to a third example.

The elevation support 3 is configured to be locked to the platform 5 in a fixed position by means of a locking mechanism 9. The locking mechanism 9 comprises a first 11' and a second (hidden) opening arranged at a first distance from each other (see e.g. FIG. 3 illustrating a front view of a third example for understanding purpose). The locking mechanism 9 comprises a first 13' and second (hidden) sliding shaft element arranged at a second distance (see e.g. FIG. 3) from each other and each is configured to slide along a second direction B2 perpendicular to the first direction. The locking mechanism 9 further comprises an adjusting device 15 configured to move at least the first opening 11' and/or at least the first 13' sliding shaft element so that the first distance corresponds with the second distance. The platform and elevation support arrangement 1 is mobile and arranged to a vehicle 16 (e.g. car, truck, boat, ship etc.)

Figure 1B:
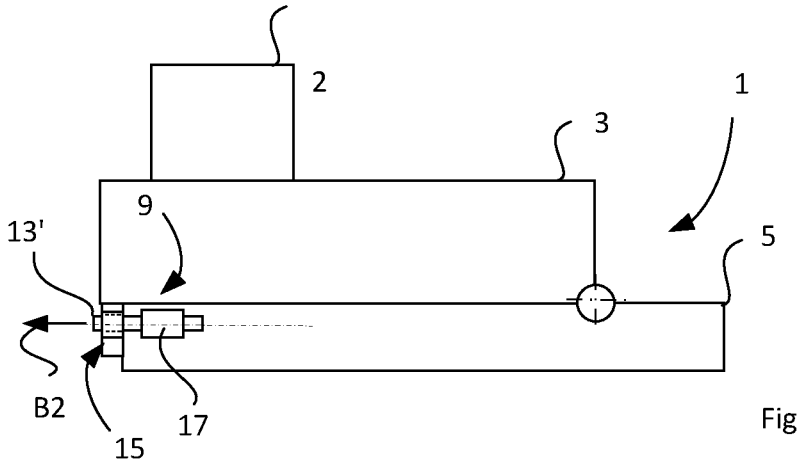
FIG. 1*b* illustrates the platform and elevation support arrangement in FIG. 1*a* in lowered position.

FIG. 1*b* illustrates the platform and elevation support arrangement 1 in FIG. 1*a* in lowered position. The adjusting device 15 is configured to move the first opening 13' in a third direction parallel or essentially parallel with the first direction (parallel with the first axis X1) enabling that the first distance will correspond with the second distance.

Before lowering the elevation support 3, the adjusting device 15 is adjusted so that the sliding shaft elements mate with the openings. Subsequently, the elevation support 3 is lowered into complete contact with the platform 5 in a transport position.

A first drive member 17' is configured to slide the first shaft element 13' into the first opening 11' and a second drive member (hidden) is configured to slide the second shaft element into the second opening (hidden).

The first opening exhibits a first central opening axis extending in the second direction B2 when the elevation support 3 is locked to the platform 5 in the fixed position.

Figure 2:
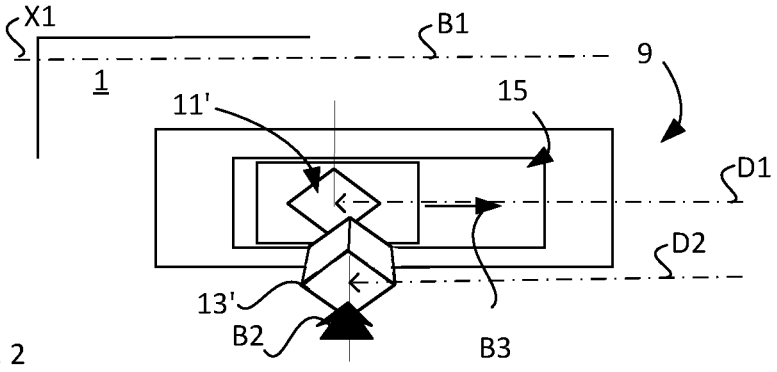
FIG. 2 illustrates an adjustable locking mechanism of a platform and elevation support arrangement according to a second example.

FIG. 2 illustrates an adjustable locking mechanism 9 of a platform and elevation support arrangement 1 according to a second example. An adjusting device 15 is configured to move a first opening 11' in a third direction B3 parallel or essentially parallel with a first direction B1 of the first axis X1 enabling that a first distance D1 between the first opening 11' and a second opening (not shown) corresponds with a second distance D2 between the first shaft element 13' and a second shaft element (not shown). The first 13' and the second sliding shaft element are configured to slide along a second direction B2 perpendicular to the first direction for locking the elevation support 3 to the platform 5.

At least the first sliding shaft element 13' may be moved as well in said third direction B3 by means of the adjusting device 15.

FIG. 3 illustrates a platform and elevation support arrangement 1 according to a third example. An elevation support 3 is hingedly mounted to a platform 5 around a first axis X1 extending along a first direction B1 via a hinge member 7 arranged between the platform 5 and the elevation support 3

The elevation support 3 is configured to be locked to the platform 5 in a fixed position by means of a locking mechanism 9.

The locking mechanism 9 comprises a first 11' and a second 11" opening arranged at a first distance D1 from each other. The locking mechanism 9 further comprises a first 13' and second 13" sliding shaft element arranged at a second distance D2 from each other.

Each first 13' and second 13" sliding shaft element is configured to slide along a second direction (not shown, but oriented orthogonally to the first axis X1).

The locking mechanism 9 comprises an adjusting device 15 configured to move at least the first opening 11' so that the first distance D1 corresponds with the second distance D2. The first D1 and second D2 distance may be measured along an extension parallel with the first axis X1.

A first drive member 17' configured to slide the first shaft element 13' into the first opening 11' and a second drive member 17" configured to slide the second shaft element 13" into the second opening 11" when the elevation support 3 is in complete contact with the platform 5 in a lowered position.

The adjusting device 15 is configured to move the first opening in a third direction parallel or essentially parallel with the first axis X1, which extends along the first direction, enabling that the first distance D1 corresponds with the second distance D2.

Figure 4:
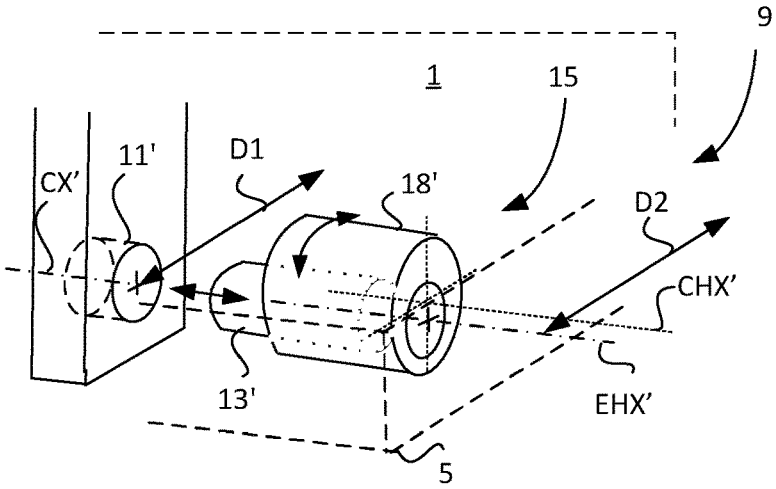
FIG. 4 illustrates an adjustable locking mechanism of a platform and elevation support arrangement according to a fourth example.

FIG. 4 illustrates an adjustable locking mechanism 9 of a platform and elevation support arrangement 1 according to a fourth example. A first opening 11' of an elevation support is formed cylindrically and defines a first opening central axis CX' extending through the first opening 11'. The locking mechanism 9 further comprises an adjusting device 15 configured to move at least a first shaft element 13' so that the first distance D1 corresponds with the second distance D2. The first shaft element 13' is housed in a first eccentric housing 18' defining a first housing central axis CHX'. The first shaft element 13' is eccentrically arranged in the first eccentric housing 18' along a first housing eccentric axis EHX'. The first eccentric housing 18' is rotated until the first housing eccentric axis EHX' is in line with the first opening central axis CX', whereby the first distance D1 corresponds with the second distance D2.

Figure 5:
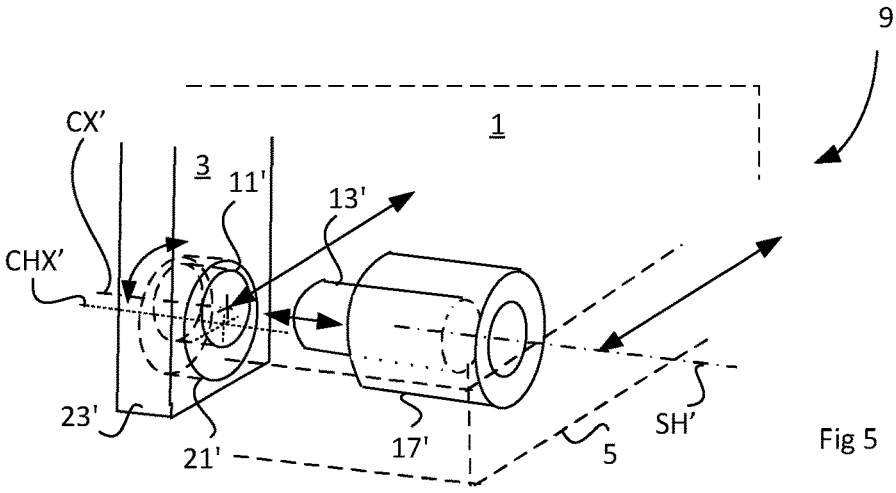
FIG. 5 illustrates an adjustable locking mechanism of a platform and elevation support arrangement according to a fifth example.

FIG. 5 illustrates an adjustable locking mechanism 9 of a platform and elevation support arrangement 1 according to a fifth example. A first opening 11' is cylindrical and defines a first opening central axis CX' extending through the first opening 11'. The first opening 11' is housed in a first eccentric housing 21' defining—and which is rotatable around—a first housing central axis CHX', so that the first opening 11' is eccentrically arranged in the first eccentric housing 21'. The first opening central axis CX' is thus eccentrically arranged relatively the first housing central axis CHX'.

The first eccentric housing 21' may be rotatable arranged in the elevation support 3 and a first sliding shaft element 13' may be arranged in the platform 5. The first sliding shaft element 13' is oriented along a first central shaft axis SX'. Workshop personnel (not shown) rotates the first eccentric housing 21' so that a first opening central axis CX' of the first opening 11' will become collinear with the first central shaft axis SX'. A first drive member 17' configured to slide the first shaft element 13' into the first opening 11'.

A second eccentric housing (not shown) may be rotatable arranged in the elevation support 3 and a second sliding shaft element (not shown) may be arranged in the platform 5.

The first eccentric housing 21' may be rotatable arranged in a first bracket 23' of the elevation support and a second opening (not shown) may be fixedly arranged in a second bracket (not shown) of the elevation support 3.

Figure 6:
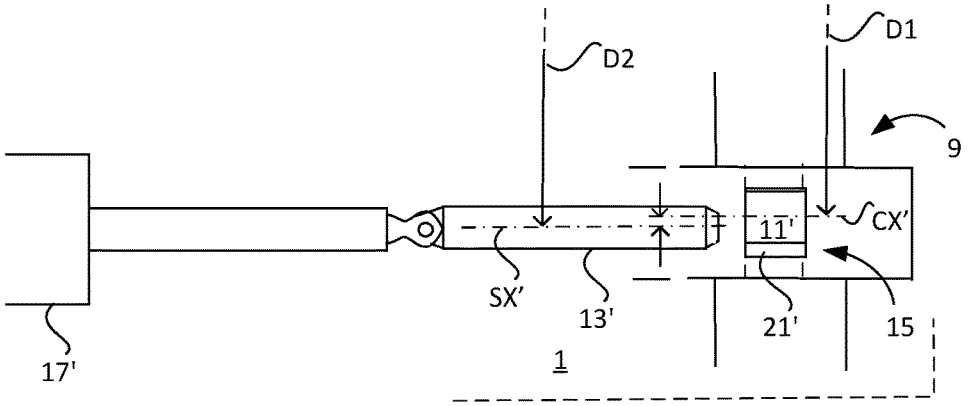
FIG. 6 illustrates an adjustable locking mechanism of a platform and elevation support arrangement according to a sixth example.

FIG. 6 illustrates an adjustable locking mechanism 9 of a platform and elevation support arrangement 1 in a view from above according to a sixth example.

The locking mechanism 9 may comprise an adjusting device 15 configured to move at least a first opening 11' so that a first distance D1 (center-to-center measurement) between a first opening central axis CX' of the first opening 11' and a second opening central axis of a second opening (not shown) corresponds with a second distance D2 (center-to-center measurement) between a first central shaft axis SX' of a first shaft slide element 13' and a second central shaft axis of a second shaft slide element (not shown).

The first opening 11' may be housed in a first eccentric housing 21' and is eccentrically arranged in the first eccentric housing 21'. Workshop personnel (not shown) rotates the first eccentric housing 21' so that the first opening central axis CX' of the first opening 11' will become collinear with the first central shaft axis SX'. The adjustable locking mechanism provides that the opening will be moved in a third direction parallel with the first axis.

A first drive member 17' configured to slide the first shaft slide element 13' into the first opening 11'. The first drive member 17' may comprise electrical linear actuator.

A second drive member (not shown) is configured to slide the second shaft slide element (not shown) into the second opening (not shown).

In such way the manufacture is made cost-effective. Time consuming production of any first and second fixed openings for achieving their correct center-to-center measurement (corresponding with the center-to-center measurement between the first and second sliding shaft element) is not any longer critical.

Figure 7A:
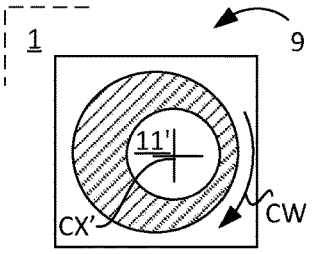
FIGS. 7*a*-7*c* illustrate an adjustable locking mechanism of a platform and elevation support arrangement according to a seventh example having a first opening eccentrically arrangedin a first eccentric housing.
Figure 7B:
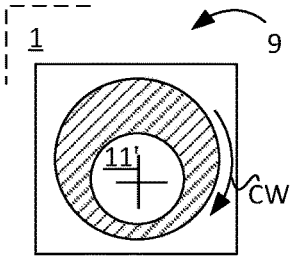
Figure 7C:
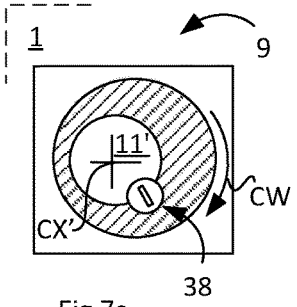

FIGS. 7*a*-7*c* illustrate an adjustable locking mechanism 9 of a platform and elevation support arrangement 1 according to a seventh example having a first opening 11' eccentrically arranged in a first eccentric housing 21'. The first opening central axis CX' of the first opening 11' is moved to the left (seen in the figure on readable held paper sheet from above) when rotating the first eccentric housing 21' clockwise CW. The first opening central axis CX' is moved in a curved direction following an imaginary plane being parallel with the first axis. The center-to-center measurement will imply that the first opening 11' ends in a position shown in FIG. 7*c*. Thereafter the locking mechanism may be fixed in position by means of a fixing device 38.

Figure 8A:
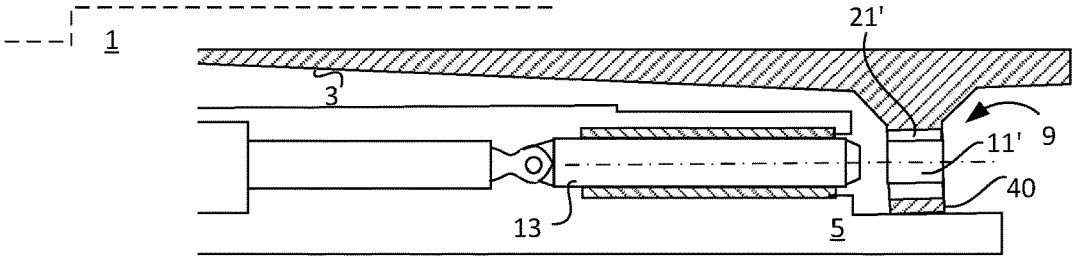
FIGS. 8*a*-8*b* illustrate an adjustable locking mechanism of a platform and elevation support arrangement according to an eight example.
Figure 8B:
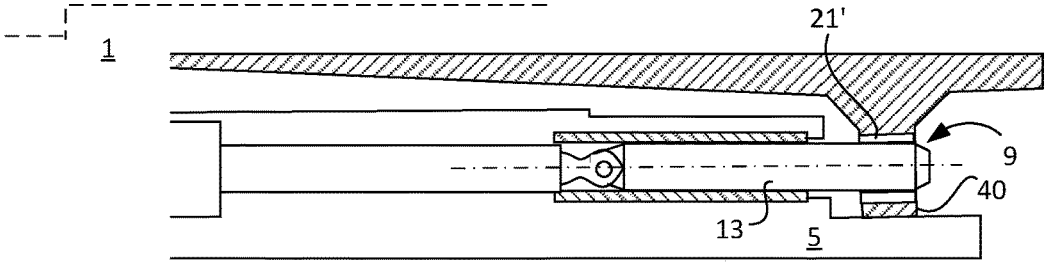

FIGS. 8*a*-8*b* illustrate an adjustable locking mechanism 9 of a platform and elevation support arrangement 1 according to an eight example. FIG. 8*a* shows a first eccentric housing 21' being rotatable arranged in a first bracket 40 of the elevation support 3 and a second opening (not shown as being hidden) is arranged in a second bracket of the elevation support 3. The elevation support 3 is locked to the platform 5 by locking the adjustable locking mechanism 9 by sliding a first shaft element 13' into a first opening 11' of the first eccentric housing 21' and by sliding the second shaft element (not shown) into the second opening. As shown in FIG. 8*b* an electrical actuator may be controlled to move the first shaft element 13' into the locking position.

Figure 9:
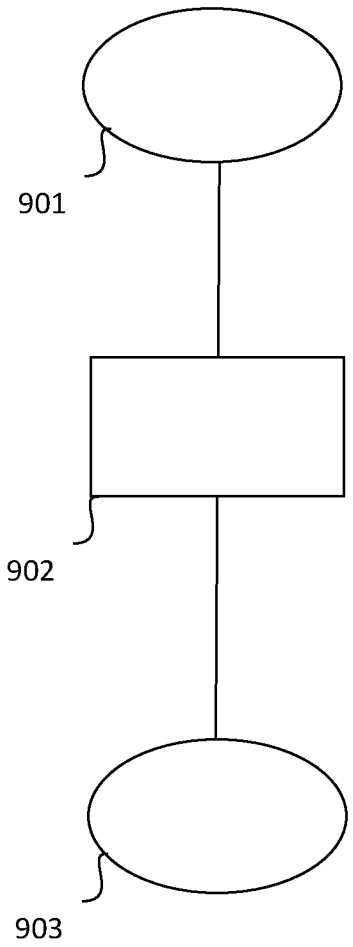
FIG. 9 illustrates a flowchart of a method according to one example.

FIG. 9 illustrates a flowchart of an exemplary method for manufacture of a platform and elevation support arrangement, wherein an elevation support is to be hingedly mounted to a platform around a first axis extending along a first direction via a hinge member arranged between the platform and the elevation support, and wherein the elevation support is configured to be locked to the platform in a fixed position by means of an adjustable locking mechanism, comprising a first and a second opening arranged at a first distance from each other and comprising a first and second sliding shaft element arranged at a second distance from each other each configured to slide along a second direction perpendicular to the first axis. The method starts with the first step 901 comprising the start of the method. The second step 902 comprises the performance of the method. The last step 903 involves the stop of the method.

The step 902 may comprise providing the platform, the elevation support and the adjustable locking mechanism; mounting the elevation support to the platform; adjusting the adjustable locking mechanism so that the first distance corresponds with the second distance; and locking the adjustable locking mechanism by sliding the first shaft element into the first opening and by sliding the second shaft element into the second opening.

Figure 10:
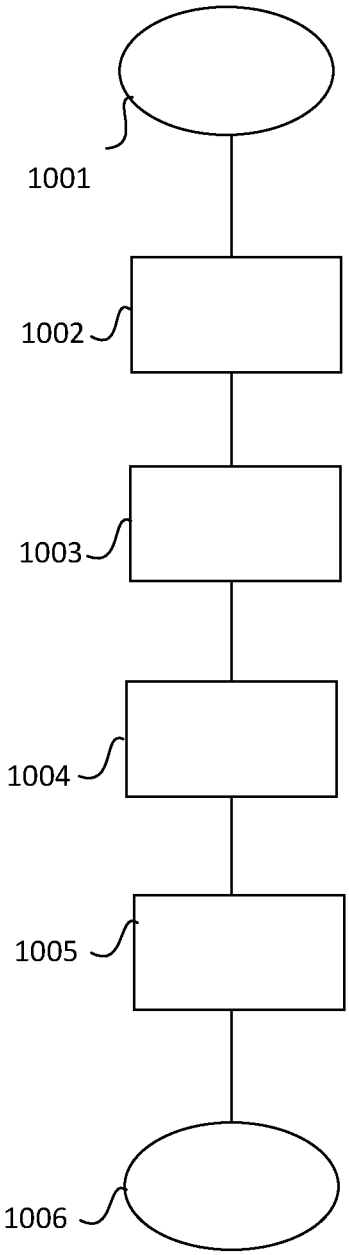
FIG. 10 illustrates a flowchart of a method according to a further example.

FIG. 10 illustrates a flowchart of an exemplary method for manufacture of a platform and elevation support arrangement; wherein an elevation support is to be hingedly mounted to a platform around a first axis extending along a first direction via a hinge member arranged between the platform and the elevation support; and wherein the elevation support is configured to be locked to the platform in a fixed position by means of an adjustable locking mechanism, comprising a first and a second opening arranged at a first distance from each other and comprising a first and second sliding shaft element arranged at a second distance from each other each configured to slide along a second direction perpendicular to the first axis.

The method comprises the first step 1001 involving the start of the method. A next step 1002 comprises the step of providing the platform, the elevation support and the adjustable locking mechanism. A next step 1003 comprises mounting the elevation support to the platform. A next step 1004 comprises adjusting the adjustable locking mechanism so that the first distance corresponds with the second distance. A yet further next step 1005 comprises locking the adjustable locking mechanism by sliding the first shaft element into the first opening and by sliding the second shaft element into the second opening. The method stops in the step 1006.

The present invention is of course not in any way restricted to the preferred embodiments described above, but many possibilities to modifications, or combinations of the described embodiments, thereof should be apparent to a person with ordinary skill in the art without departing from the basic idea of the invention as defined in the appended claims.

The invention claimed is:

1. A method for manufacture of a platform and elevation support arrangement (1), wherein an elevation support (3) is to be hingedly mounted to a platform (5) around a first axis (X1) extending along a first direction (B1) via a hinge member (7) arranged between the platform (5) and the elevation support (3), wherein the elevation support (3) is configured to be locked to the platform (5) in a fixed position by means of an adjustable locking mechanism (9), wherein the elevation support (3) is in a lowered and locked state relative to the platform, wherein the adjustable locking mechanism (9) comprises a first and a second opening (11', 11") arranged at a first distance (D1) from each other and a first and second sliding shaft element (13', 13") arranged at a second distance (D2) from each other, and wherein each of the first and second sliding shaft elements are configured to slide along a second direction (B2) perpendicular to the first axis (X1), the method comprising the steps of:

providing the platform (5), the elevation support (3) and the adjustable locking mechanism (9);

mounting the elevation support (3) to the platform (5);

adjusting the adjustable locking mechanism (9) so that the first distance (D1) corresponds with the second distance (D2); and locking the adjustable locking mechanism (9) by sliding the first shaft element (13') into the first opening (11') and by sliding the second shaft element (13") into the second opening (11"), wherein:

the step of adjusting the adjustable locking mechanism comprises moving at least one of the first opening (11') or the first sliding shaft element (13') in a third direction (133) parallel with the first direction (131), said moving of at least one of the first opening (11') or the first sliding shaft element (13') is performed by rotating a first eccentric housing (21') comprising at least one of said first opening or the first sliding shaft element around an eccentric housing axis extending perpendicular to the first axis (X1), the first eccentric housing (21') is rotatably positioned in the elevation support (3) and the first sliding shaft element (13') is positioned in the platform (5).

2. The method according to claim 1, wherein the step of adjusting the adjustable locking mechanism (9) comprises moving the at least first opening (11') in the third direction (B3) in an imaginary plane being parallel with the first axis (X1).

3. The method according to claim 2, wherein the step of locking the locking mechanism (9) in a fixed position comprises the step of securing a fixing device (38) to the locking mechanism (9).

4. A platform and elevation support arrangement (1) comprising:

an elevation support (3) hingedly mounted to a platform (5) around a first axis (X1) extending along a first direction (B1) via a hinge member (7) arranged between the platform (5) and the elevation support (3), wherein:

the elevation support (3) is configured to be locked to the platform (5) in a fixed position by means of an adjustable locking mechanism (9), the elevation support (3) is in a lowered and locked state relative to the platform (5), and the adjustable locking mechanism (6) comprises:

a first and a second opening (11' 1") arranged at a first distance (D1) from each other, a first and second sliding shaft element (13', 13") arranged at a second distance (D2) from each other, each being configured to slide along a second direction (B2), an adjusting device (15) configured to move at least one of the first opening (11') or the first sliding shaft element (13') so that the first distance (D1) corresponds with the second distance (D2), the adjusting device being configured to move at least one of the first opening (11') or the first sliding shaft element (13') in a third direction (B3) parallel with the first direction (B1) such that the first distance (D1) corresponds with the second distance (D2), said moving of at least one of the first opening (11') or the first sliding shaft element (13') being performed by rotating a first eccentric housing (21') comprising at least one of said first opening or the first sliding shaft element around an eccentric housing axis that extends perpendicular to the first axis (X1), the first eccentric housing (21') being rotatably positioned in the elevation support (3) and the first sliding shaft element (13') being positioned in the platform (5), a first drive member (17') configured to slide the first shaft element (13") into the first opening (11'), and a second drive member (17") configured to slide the second shaft element (13") into the second opening (11").

5. The platform and elevation support arrangement (1) according to claim 4, wherein:

the first opening (11') is cylindrical and defines a first opening central axis (CX') extending through the first opening (11'), the first opening (11') is housed in a first eccentric housing (21') defining a first housing central axis (CHX'), and the first opening (11') is eccentrically arranged in the first eccentric housing (21').

6. The platform and elevation support arrangement (1) according to c wherein the elevation support (3) carries a radar antenna unit (2).

7. The platform and elevation support arrangement (1) according to claim 4, wherein locking the locking mechanism (9) is configured to be secured in a fixed position relative the elevation support (3) by means of a fixing device (38).

* * * * *